US006082594A

United States Patent [19]

Pickens

[11] Patent Number: 6,082,594

[45] Date of Patent: Jul. 4, 2000

[54] SNOWFALL SIMULATOR WITH AGITATING DISPENSER

[75] Inventor: Timothy James Pickens, Lutz, Fla.

[73] Assignee: Snowmaker Productions, Inc., Lutz, Fla.

[21] Appl. No.: 09/224,325

[22] Filed: Dec. 31, 1998

[51] Int. Cl.[7] ..... B67D 5/58; B67D 3/00; G01F 11/00; G09F 19/00; A63G 31/00

[52] U.S. Cl. ..... 222/189.05; 222/228; 222/485; 40/410; 472/65

[58] Field of Search ..... 222/189.05, 200, 222/333, 409, 485, 565, 228; 40/410; 472/65; 312/210.5; 209/315, 341, 342; 239/689

[56] References Cited

U.S. PATENT DOCUMENTS

| | | | |
|---|---|---|---|
| 241,924 | 5/1881 | Bushwell . | |
| 335,709 | 2/1886 | Lovin . | |
| 1,101,422 | 6/1914 | Fielding . | |
| 2,363,348 | 11/1944 | Maurice | 209/315 |
| 2,543,606 | 2/1951 | Solomon . | |
| 2,587,620 | 3/1952 | Harmon . | |
| 2,897,619 | 8/1959 | Zenz . | |
| 3,243,183 | 3/1966 | De Scrange . | |
| 3,494,614 | 2/1970 | Taylor . | |
| 3,643,797 | 2/1972 | Berkowitz et al. | 209/315 |
| 3,999,750 | 12/1976 | Perkins . | |
| 4,028,830 | 6/1977 | Ottinger . | |
| 4,076,234 | 2/1978 | Burnbaum . | |
| 5,098,084 | 3/1992 | Culver . | |
| 5,202,239 | 4/1993 | Chen . | |
| 5,289,954 | 3/1994 | Briiggendick et al. | 222/408 |
| 5,632,419 | 5/1997 | Pickens . | |

FOREIGN PATENT DOCUMENTS

| | | |
|---|---|---|
| 610758 | 6/1978 | U.S.S.R. . |

*Primary Examiner*—Kevin Shaver
*Assistant Examiner*—David A. Bonderer

[57] ABSTRACT

A snowfall simulator which houses and dispenses artificial snow from a box-like housing 20 using agitation. The housing or dispenser has openings 32 uniformly placed on the bottom horizontal plane. Thin shredded white plastic flakes, used for snow, are placed inside and the machine which is mounted directly over the desired area. A small motor 14 is attached to the housing. A light-weight reticulated agitation plate 24, fastened to a support rod 25, resting on the inside bottom horizontal plane of housing, is pivotally connected by gear 16 and shaft 18 to motor. A series of rods 29 and paddles 31 are pivotally attached to rod 25. A series of slats are fastened to the sides of housing, just above, and perpendicular to, the agitation plate 24 and rod 25. The linear motion of the grid 24, rod 25, and push rods 29 and paddles 31, works to slowly agitate the snow flake material out of the housing through the exit holes and onto the window display, theatrical stage, display case, or event. Once empty, the snow can be collected and reused for further enjoyment.

2 Claims, 1 Drawing Sheet

EXPLODED VIEW

SNOWFALL SIMULATOR WITH AGITATING DISPENSER

BACKGROUND

1. Field of Invention

This invention relates to decorative seasonal merchandise, the visual display industry, the party industry, and theatrical special effects. In specific, an invention which creates the effect of gentle falling snow over a retail store's window display, a Christmas tree, drama, party or event.

BACKGROUND

2. Description of Prior Art

The desire to produce a long-lasting, silent, realistic snowfall effect as part of the display scheme of windows, Christmas trees, seasonal displays, exhibits or parties has been around for a while. While several inventions produce an artificial snowfall effect such as U.S. Pat. No. 1,101,422, Fielding, Jul. 18, 1913; U.S. Pat. No. 4,028,830, Ottinger, Jun. 14, 1977 and U.S. Pat. No. 3,999,750, Perkins, December, 1975, none of them incorporate the mechanics, housing, or features which are a part of this invention. Other inventions not related to seasonal merchandise or the visual display industry have some aspects which are similar but do not encompass the full scope of the invention at hand. Foreign Patent SU 610,758, from Zhvaniya, USSR, uses agitation to eliminate granular material but its reciprocating bottom plate is not elevated, has a different shape, and appears that it can dispense only semi-smooth, hard, rounded and heavier material consistently. Other methods of agitation in the same agricultural field are noted: U.S. Pat. No. 241,924, Bushwell, May 24, 1881; U.S. Pat. No. 335, 709, Lovin, Feb. 9, 1886.

This patent is an improvement over U.S. Pat. No. 5,632, 419, Pickens, May 27, 1997. While the patent to Pickens is significant, it fails to produce a consistent snowfall for long periods of time using larger and flatter plastic type flakes desirous in larger displays. Consequently, while a certain amount of larger, flatter snow flake material will dispense (patent to Pickens), its operation time is limited. Light, flat, flaky material which is piled on itself within a housing with sides tends to pack together under its own weight and gravitational pressures. Therefore, successful operation over a long period of time depends on individual flakes being loose and dispensed, falling one or two at a time. The lack of adequate air or space between each flake in the patent to Pickens prevents this successful operation. Therefore, while a smaller grain-like material used for snow may dispense, as seen in the patent to Pickens, a larger, flatter flake made from a roughly shredded thin while plastic will pack down, become dense, and not be released through the bottom holes. Furthermore, once the larger, flatter flakes are packed together they tend to ride above and on top of the agitation plate, creating more weight and friction. Therefore, tension on the motor is increased. The disclosure of Pickens in U.S. Pat. No. 5,632,419 is herein incorporated by reference.

OBJECTS AND ADVANTAGES

It is therefore an object of the invention to create an individual snow machine for mainly large displays, events, and theatrical productions which:

(a) can dispense various types of larger, flatter more natural looking flakes, and (b) can hold more flake material, and (c) can work for a longer period of time.

Further objects and advantages will become apparent from a consideration of the drawings and ensuing description.

DRAWING FIGURES

Figure 1:
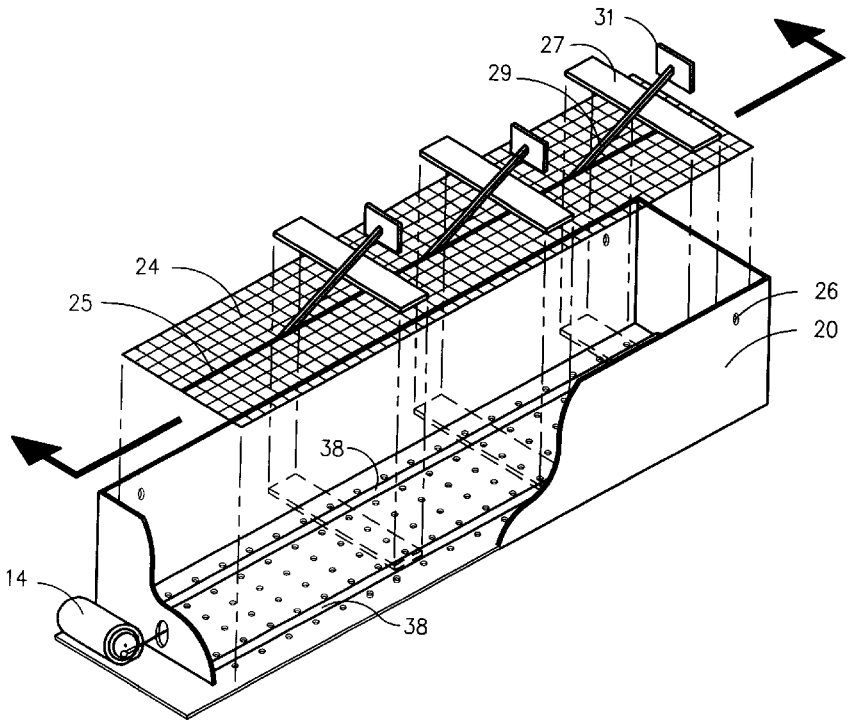
FIG. 1 is an exploded elevational view of apparatus of invention.
Figure 2:
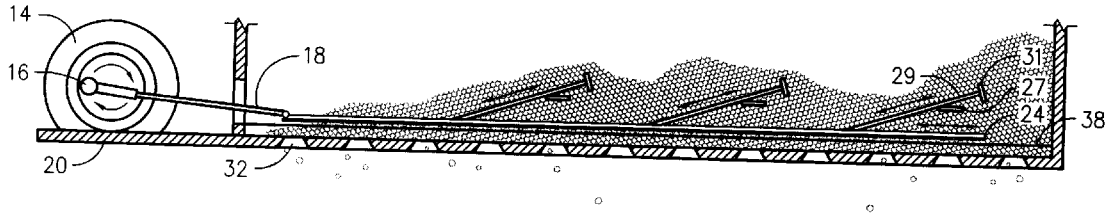
FIG. 2 is a vertical cross-sectional taken along a longitudinal axis of the apparatus of FIG. 1, the view depicting one extremum of the linear motion of a grid.
Figure 3:
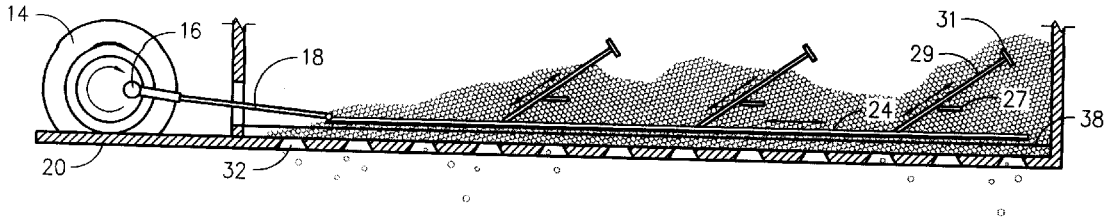
FIG. 3 is the same vertical cross-section as in FIG. 2, the view of FIG. 3 depicting the other of the two extrema of the linear motion of the grid.

| REFERENCE NUMERALS IN DRAWINGS |
|---|
| 14 motor |
| 16 eccentric plate |
| 18 shaft |
| 20 base housing |
| 24 agitation grid |
| 25 mounting rod |
| 26 ceiling mount holes |
| 27 slat |
| 29 push rod |
| 31 paddle |
| 32 exit holes |
| 38 dowel riser |

DETAILED DESCRIPTION

FIG. 1 shows a basic version of this invention. The base dispensing unit, of housing 20 comprises of uniformly spaced openings or exit holes 32 on its bottom horizontal plane. Base 20 is made of a lightweight material such as plastic or cardboard. Mounting holes 26 along the top edge of housing 20 allow for easy mounting with wire or monofilament line to a wall or other support that forms no part of the invention. A reticulated agitation grid or mesh 24 is fastened preferably to a lightweight rod or bar 25 made preferably of wood or plastic. The grid 24 and rod 25, are shorter than the length of the interior of the box or housing 20. Grid 24 is slightly elevated off the bottom and mounted for slidable motion on risers 38 attached to the bottom of housing 20. A motor 14 powered by DC or AC current is mounted on the box 20. An eccentric plate 16, attached to motor 14, is linked to the grid 24 by a shaft 18. The shaft 18 is pivotally attached to both the eccentric plate 16 and the grid 24. Attached to the housing 20 and just above the grid 24 and rod 25 are a plurality of slats 27 preferably perpendicular to grid 24. A pivoting push rod 29 and paddle 31 are mounted to rod 25.

The preferred type of snow for this invention is a roughly shredded thin white plastic sheet. The individual flakes can vary in size and shape up to about the one inch or more in width and length. The preferred thickness of the white plastic is from 1.5 mil to 2 mil. Given that other materials, such as artificial fall leaves and confetti, can be made to have similar proportions, other effects can be made other than just falling snow. However, most any material which produces the characteristics of gentle falling snow may be used in this invention.

The goal driving this invention is to produce a long-lasting, uninterrupted, snowfall effect over a retail store's window displays, exhibits and theatrical productions. The horizontal motion of the reticulated agitation grid or mesh 24 and rod 25, generated by the motor 14 and eccentric plate 16, slowly agitates the snow flake material, allowing it to release and fall through the exit holes 32 on the bottom housing 20. To improve the inventions' performance in this respect, small lightweight slats 27 are attached to the sides of housing 20, preferably at right angles to the horizontal motion or axis of the reticulated plate 24 and rod 25. The slats 27, which elevate the naturally packed snow material off of plate 24 and rod 25, reduces weight and friction and allows a trickle down supply of snow from above. Additionally, a plurality of push rods 29 and paddles 31, are pivotally attached to the reciprocating rod 25. The opposing end of the push rod rests on the slat 27, which acts as a fulcrum for the moving push rod, and forces the push rod and paddle in a reciprocating horizontal and vertical motion into and under the snow material resting on the slats. This action from rod 29 and paddle 31 keeps the snow material from becoming static and packed together above the slats, thus increasing the amount of snow which can be housed and dispensed, and increasing the amount of air and space between the flake material near the exit holes 32. Risers 38, which may comprise wooden dowel rods, help limit friction of plate 24 on the bottom of the housing 20 thereby reducing stress on the motor 14.

CONCLUSION, RAMIFICATIONS, AND SCOPE OF INVENTION

Thus the reader will see that the improved snowfall simulator can dispense more and larger, flatter snowflake type material for a longer period of time compared to U.S. Pat. No. 5,632,419, to Pickens. While my above description and operation may contain many specificities, these should not be construed as limitations on the scope of the invention, but rather as an exemplification of one preferred embodiment thereof. Many other variations are possible. For example, there may be several ways to create a motion of plate 24 which sufficiently agitates snow flake material and expels it from the housing 20. One may use circular motion or vibration or any combination of vertical, horizontal, linear, and circular motion instead of just linear motion for the reticulated grid 24. Instead of an eccentric plate 16 one could incorporate a planetary gear or a simple oscillating shaft attached perpendicular to the motor shaft. The grid 24 can be replaced by a conveyor type system with moving rods or bars or other shapes which move under, on top of, or in the snow to agitate it sufficiently out of the housing. The grid 24 can be mounted in various positions inside or outside the box. Handles which could run parallel to slats 27 may be added in place of the ceiling mount holes; this would add further stability to the housing 20. The housing 20, which can be made of various materials, can be of various shapes such as round or square or shaped in such a way to look more natural or cloud-like. The portable housing 20 can be replaced by a permanently fixed receptacle in the top of a small or large display case in which a snowfall effect could be generated inside the case. A vacuum could be adapted or modified to return the flake material to the top of case once empty. Riser 38 may be parallel or at right angles to the plate 24 and may be hollow and may have shapes other than round such triangle or square, etc. It may not be necessary to have risers 38 since the grid 24 can work without elevation and there may be other ways to reduce friction between the grid 24 and housing 20 such as using a slick material on the bottom of the housing 20. One can also create small channel on the inside sides of housing 20 which supports and allows for the motion of grip 24. The push rod 29, which may also be flexible, can be attached to slat 27 with a pilot hole or sleeve in such a way as to allow free movement but to not be separated too far from the slat. The push rod 29 and paddle 31 may take on various shapes and may not be pivoting but rather fixed on the rod 25 in a vertical or angled position. The slat can be of various shapes such as round, square, or triangular.

Thus, the scope of the invention should be determined by the appended claims and their legal equivalents, rather than by the examples given.

What is claimed is:

1. A snowfall simulative apparatus comprising:

a housing having a bottom surface, the bottom surface having a plurality of throughholes therethrough;

a grid mounted for reciprocating motion within the housing, the grid having a reciprocating rod fixedly attached thereto;

the reciprocating rod having a predetermined number of push rods pivotally attached thereto, each of the push rods having a paddle attached to the end thereof distal from the reciprocating rod; and a predetermined number of slats fixedly attached to the housing transverse to the reciprocating rod, each of the slats engaging a respective one of the push rods.

2. A snowfall simulative apparatus comprising:

a housing having a bottom surface, the bottom surface having a plurality of throughholes therethrough;

a reticulated grid mounted for reciprocating motion within the housing, the grid having a reciprocating rod fixedly attached thereto;

the reciprocating grid having a predetermined number of arms or rods fixedly attached thereto, each of the rods having a paddle or cross member attached to the end thereof distal from the reciprocating rod; and a predetermined number of slats or bars fixedly attached to the housing just above the grid.

* * * * *